United States Patent [19]

Rosenberg

[11] 4,417,957

[45] Nov. 29, 1983

[54] AQUEOUS ACID PLATING BATH AND BRIGHTENER MIXTURE FOR PRODUCING SEMIBRIGHT TO BRIGHT ELECTRODEPOSITS OF TIN

[75] Inventor: William E. Rosenberg, Strongsville, Ohio

[73] Assignee: Columbia Chemical Corporation, Macedonia, Ohio

[21] Appl. No.: 414,582

[22] Filed: Sep. 3, 1982

[51] Int. Cl.[3] ..... C25D 3/32

[52] U.S. Cl. ..... 204/54 R; 204/DIG. 2

[58] Field of Search ..... 204/54 R, 43 S, 120, 204/DIG. 2, 123

[56] References Cited

U.S. PATENT DOCUMENTS 4,139,425 2/1979 Eckles et al. ..... 204/43 S

*Primary Examiner*—G. L. Kaplan

*Attorney, Agent, or Firm*—Oldham, Oldham, Hudak, Weber & Sand

[57] ABSTRACT

A tin brightener mixture for plating baths comprises chlorinated acetophenones, emulsifying agents, and acrylic or methacrylic acid. Additionally, aromatic aldehydes can be utilized. The tin brightener yields semibright to bright deposits from 0 to over 150 amps per square foot.

19 Claims, No Drawings

AQUEOUS ACID PLATING BATH AND BRIGHTENER MIXTURE FOR PRODUCING SEMIBRIGHT TO BRIGHT ELECTRODEPOSITS OF TIN

TECHNICAL FIELD

The present invention relates to an aqueous acid electroplating bath for producing semibright to extremely bright electrodeposits of tin. Additionally, the present invention relates to a brightening mixture and an acid plating bath containing the brightening mixture which produces more uniform deposits over a very broad current density range than with previously known tin plating baths.

BACKGROUND ART

Plating baths and plating additives heretofore utilized include those set forth in U.S. Pat. No. 3,755,096 to Passal; U.S. Pat. No. 3,875,029 to Rosenberg et al; U.S. Pat. No. 3,977,949 to Rosenberg; U.S. Pat. No. 4,061,547 to Rosenberg; and U.S. Pat. No. 4,072,582 to Rosenberg. However, none of these plating baths or tin brighteners are pertinent to the present invention since they do not relate to or suggest the same additives.

DISCLOSURE OF INVENTION

Accordingly, it is an aspect of the present invention to provide a brightening mixture which produces uniform semibright to bright electrodeposits of tin.

It is another aspect of the present invention to provide certain chlorinated acetophenones as a brightening agent.

It is a further aspect of the present invention to provide a tin plating bath having a certain chlorinated acetophenone brightening agent which acts synergistically with acrylic acid and methacrylic acid to give uniform semibright to bright electrodeposits of tin over a broad current density range.

It is yet a further aspect of the present invention to provide a tin plating bath, as above, wherein emulsifiers are utilized to disperse the brightening agent.

It is still another aspect of the present invention to provide a tin plating bath, as above, wherein certain aromatic aldehydes are added to increase the level of brightness of the electrodeposited tin.

These and other aspects of the present invention, together with the advantages thereof over existing prior art compounds and methods, are herein described and claimed.

In general, a primary tin plating brightening mixture, comprises: from about 1 to about 25 percent by weight of a chlorinated acetophenone having the formula:

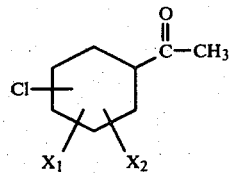

where $X_1$ and $X_2$ are ring substituted chlorine atoms or hydrogen atoms, and from about 1 to about 97 percent by weight of a compound selected from the grop consisting of acrylic acid, methacrylic acid, and combinations thereof.

Additionally, an aqueous acid electroplating bath containing stannous ions and sulfuric acid for producing electrodeposits of tin, comprises: from about 0.005 to about 0.2 grams per liter of bath solution of a chlorinated acetophenone having the formula:

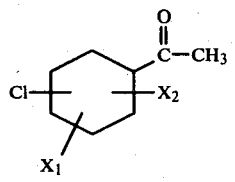

where $X_1$ and $X_2$ are ring substituted chlorine atoms or hydrogen atoms.

BEST MODE FOR CARRYING OUT THE INVENTION

According to the concepts of the present invention, it has been found that semibright to bright electrodeposits can be obtained from an aqueous acid tin plating bath when certain chlorinated acetophenones are used as primary brighteners. It has also been found that these chlorinated acetophenones act synergistically with acrylic acid and methacrylic acid to produce extremely uniform, semibright to bright electrodeposits of tin with greatly reduced pitting. The effect is truly synergistic in that the results obtained with this combination far exceeded those of using the two types of compounds separately.

The chlorinated acetophenones have the following general formula:

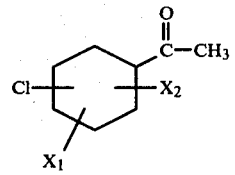

where $X_1$ and $X_2$ are ring substituted chlorine atoms or hydrogen atoms. The preferred compounds have a chlorine atom substituted in either the para position or one ortho position of the benzene ring, or both the para position and one ortho position.

The chlorinated acetophenones are generally used at a concentration of about 0.005 to about 0.2 grams/liter of plating bath and the preferred concentration is about 0.01 to about 0.05 grams/liter. They can be added to the bath in concentrated form or as dilute solutions in various suitable solvents such as methanol and ethanol. As a component of the brightener mixture, they exist in an amount of from about 1 to about 25 percent by weight, and preferably from about 1 percent to about 10 percent by weight. Most of the chlorinated acetophenones are readily available in commerce.

Since the chlorinated acetophenones exhibit limited solubility in the plating bath, emulsifying agents generally must be used to disperse them. A brightener mixture may therefore contain from about 1 percent to about 96 percent by weight, and preferably from about 20 percent to about 50 percent by weight of the emulsifying agent based upon the total weight of the mixture. The types of emulsifying agents can be anionic, nonionic, cationic, amphoteric, and mixtures thereof. They are used in the plating bath in a concentration of from about 2 to about 40 grams/liter, desirably from about 2 to about 10 grams, with an optimum amount being about 4 grams per liter.

The preferred emulsifying agents have been found to be the nonionics and modified nonionics. By modified nonionic, it is meant a polyethoxylated compound to which has been added one or more cationic groups, one or more anionic groups, or both. The nonionic emulsifying agents are generally made by condensing ethylene oxide with lipophilic groups such as long chain fatty alcohols, long chain fatty amines, long chain fatty acids, and long chain alkyl phenols, the long chain containing from 2 to about 30 carbon atoms, and preferably from 6 to 15 carbon atoms. The optimum amount of ethylene oxide is about 10 to 30 moles per mole of lipophile. While these are the highly preferred nonionics, it is not meant to limit the invention to these types only. For example, ethylene oxide derivatives of naphthols and polysaccharides also perform satisfactorily. In addition, propylene oxide condensates and ethylene oxide-propylene oxide block copolymers are also considered part of the present invention. The modified nonionic emulsifying agents have increased solubility in the plating bath.

Some of the commercially available emulsifying agents of this invention are Surfonic N-150 made by the Air Products Corp.; Tergitol TMN-10 made by Union Carbide Corp.; Tetronic 504 made by BASF Wyandotte, Inc.; and Triton QS-15 made by Rohm and Haas, Inc.

Acrylic acid and methacrylic acid are used in a concentration of from about 0.02 to about 5 grams/liter, preferably from about 0.02 to about 1.0 grams/liter, of bath to act synergistically with the chlorinated acetophenones in producing semibright to bright electrodeposits of tin that are uniform and exhibit very little pitting. They may also be a part of a brightener mixture containing the chlorinated acetophenone and from about 1 to about 97 percent by weight, desirably 5 to 30 percent by weight, of the acrylic acid or methacrylic acid. Of course, an emulsifying agent may also be added to this mixture wherein the amount of emulsifying agent range is the same as set forth above. A preferred mixture of the present invention contains all three components (chlorinated acetophenone, acrylic or methacrylic acid, and emulsifying agent) and even a suitable solvent such as methyl alcohol, ethyl alcohol, or a glycol ether. The amount of solvent can range from about 1 to about 80 percent by weight.

It has also been found that the addition of certain aromatic aldehydes along with the chlorinated acetophenones, acrylic and methacrylic acid, and emulsifying agent, produces even brighter electrodeposits of tin. The aromatic aldehydes that have been found to be most effective are o-chlorobenzaldehyde, 2,4-dichlorobenzaldehyde, o-methoxybenzaldehyde, salicylaldehyde, o-anisaldehyde, and 2-hydroxy-1-naphthaldehyde in a concentration of from about 0.005 to about 0.2, and preferably from about 0.005 to about 0.05 grams/liter of plating bath. Any of the aromatic aldehydes can be included in the brightener mixture as described above in a concentration of from about 1 to 25 percent by weight of the total mixture, with from about 1 to about 15 percent being preferred.

While the brightening mixtures of this invention are effective in many aqueous acid tin plating bath formulations, it is preferred to use any of the basic baths described in the following examples. In general, a source of stannous ions such as stannous sulfate is present. A suitable amount is from about 10 to about 100 grams/liter. Also present is sulfuric acid in a concentration of from about 50 to about 260 grams/liter. The plating baths used in the following samples all contained 180 grams of sulfuric acid per liter and 30 grams of stannous sulfate per liter.

TABLE I

| Additive | Concentration in g/l |
|---|---|
| EXAMPLE I | |
| Surfonic N-150 (nonylphenol polyethoxylate) | 4 |
| Methacrylic acid | 0.6 |
| o-chloroacetophenone | 0.04 |
| EXAMPLE II | |
| Surfonic N-150 | 4 |
| Acrylic acid | 0.1 |
| p-chloroacetophenone | 0.04 |
| EXAMPLE III | |
| Surfonic N-150 | 4 |
| Methacrylic Acid | 0.6 |
| p-chloroacetophenone | 0.04 |
| EXAMPLE IV | |
| Surfonic N-150 | 4 |
| Methacrylic acid | 0.6 |
| 2,4-dichloroacetophenone | 0.04 |
| EXAMPLE V | |
| Tergitol TMN-10 (Linear alcohol polyethoxylate) | 5 |
| Methacrylic acid | 0.6 |
| 2,3,4-trichloroacetophenone | 0.04 |
| EXAMPLE VI | |
| Ethoxylated beta-Naphthol (12 moles ethylene oxide) | 4 |
| Methacrylic acid | 0.6 |
| 2,3,4-trichloroacetophenone | 0.04 |
| EXAMPLE VII | |
| Same as Example IV but including o-chlorobenzaldehyde | 0.02 |
| EXAMPLE VIII | |
| Same as Exhibit V but including 2-hydroxy-1-naphthaldehyde | 0.02 |
| EXAMPLE IX | |
| Same as Example IV but including Salicylaldehyde | 0.01 |
| EXAMPLE X | |
| Same as Example IV but including o-anisaldehyde | 0.01 |
| Same as Example IV but including o-anisaldehyde | 0.01 |
| EXAMPLE XI | |
| Same as Exhibit 1 but not containing any o-chloroacetophenone. | |

All testing was done in a conventional 267 ml. Hull Cell, using steel cathode panels and tin anodes. A current of 2 amperes was used for 5 minutes at temperatures ranging from 70° to 85° F. Some mechanical agitation was used to prevent gas streaking. The results of tests using Examples I through XI are discussed in Table II.

TABLE II

| Results of Plating Tests | |
|---|---|
| EXAMPLE I | Semibright deposit from 0 to 90 amps/sq. ft. Bright deposit from 90 amps/sq. ft. to well over 150 amps/sq. ft. |
| EXAMPLE II | Semibright deposit from 0 to 40 amps/sq. ft. Bright deposit from 40 amps/sq. ft. to well over 150 amps/sq. ft. |
| EXAMPLE III | Semibright deposit from 0 to 11 amps/sq. ft. Bright deposit from 11 amps/sq. ft. to well over 150 amps/sq. ft. |
| EXAMPLE IV | Semibright deposit from 0 to 30 amps/sq. ft. Bright deposit from 30 amps/sq. ft. to well over 150 amps/sq. ft. |

TABLE II-continued

| | Results of Plating Tests |
|---|---|
| EXAMPLE V | Semibright deposit from 0 to 65 amps/sq. ft. Bright deposit from 65 amps/sq. ft. to well over 150 amps/sq. ft. |
| EXAMPLE VI | Semibright deposit from 0 to 15 amps/sq. ft. Bright deposit from 15 amps/sq. ft. to well over 150 amps/sq. ft. |
| EXAMPLE VII | Very bright deposit from 0 to well over 150 amps/sq. ft. |
| EXAMPLE VIII | Very bright deposit from 0 to well over 150 amps/sq. ft. |
| EXAMPLE IX | Semibright deposit from 0 to 6 amps/sq. ft. Very bright deposit from 6 to well over 150 amps/sq. ft. |
| EXAMPLE X | Very bright deposit from 0 to well over 150 amps/sq. ft. |
| EXAMPLE XI | Dull coarse deposits from 0 to well over 150 amps/sq. ft. |

Having thus described this invention in such full, clear, and concise, and exact terms as to enable any person skilled in the art to which it pertains to make and use the same, and having set forth the best mode contemplated of carrying out this invention, in accordance with the patent statutes, the subject matter which is regarded as being my invention is particularly pointed out and distinctly claimed in the appended claims.

What is claimed is:

1. A primary tin plating brightening mixture, comprising:

from about 1 to about 25 percent by weight of a chlorinated acetophenone having the formula:

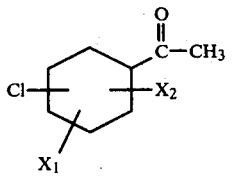

where $X_1$ and $X_2$ are ring substituted chlorine atoms or hydrogen atoms, and from about 1 to about 97 percent by weight of a compound selected from the group consisting of acrylic acid, methacrylic acid, and combinations thereof.

2. The mixture according to claim 1 including from 1 to about 96 percent by weight of at least one emulsifying agent selected from the group consisting of nonionic, modified nonionic, cationic, anionic, and amphoteric emulsifying agents, and combinations thereof.

3. The mixture according to claim 2 wherein said emulsifying agent is selected from the group consisting of a nonionic or a modified nonionic emulsifying agent.

4. The mixture according to claim 3, wherein said nonionic emulsifying agent is made by condensing ethylene oxide with a lipophilic compound, said lipophilic compound selected from the group consisting of a long chain fatty alcohol, a long chain fatty amine, a long chain fatty acid, a long chain alkylphenol, naphthol, and polysaccharides, said long chain containing from about 2 to 30 carbon atoms, and wherein from about 10 to about 30 moles of said ethylene oxide are used per mole of said lipophilic compound.

5. The mixture according to claim 4, wherein said chlorinated acetophenone compound has a chlorine atom substituted in the para position or in the ortho position, or in both the para and one ortho position.

6. The mixture according to claim 1, 2, 3, 4, or 5, including from about 1 to about 25 percent of at least one aromatic aldehyde selected from the group consisting of salicylaldehyde, o-methoxybenzaldehyde, o-chlorobenzaldehyde, 2,4-dichlorobenzaldehyde, 2-hydroxy-1-naphthaldehyde, o-anisaldehyde, and combinations thereof.

7. The mixture according to claim 6, wherein the amount of said chlorinated acetophenone ranges from about 1 to about 10 percent by weight, wherein the amount of said emulsifying agent ranges from about 20 to about 50 percent by weight, and wherein the amount of said acrylic or methacrylic acid ranges from about 5 to about 30 percent by weight, based upon the total weight of said additive.

8. The mixture according to claim 7, wherein said chlorinated acetophenone is selected from the group consisting of 2,4-dichloroacetophenone, 2,3,4-trichloroacetophenone, o-chloroacetophenone, and p-chloroacetophenone, and wherein the amount of said aromatic aldehyde is from about 1 to about 15 percent.

9. The mixture according to claim 8, wherein said acid is methacrylic acid.

10. An aqueous acid electroplating bath containing stannous ions and sulfuric acid for producing electrodeposits of tin, comprising:

from about 0.005 to about 0.2 grams per liter of bath solution of a chlorinated acetophenone having the formula:

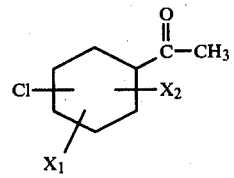

wherein $X_1$ and $X_2$ are ring substituted chlorine atoms or hydrogen atoms.

11. The bath according to claim 10, including from about 2 to about 40 grams per liter of an emulsifying agent, said emulsifying agent is selected from the group consisting of nonionic, modified nonionic, anionic, cationic, and amphoteric emulsifying agents, and combinations thereof.

12. The bath according to claim 11, including from about 0.02 to about 5 grams per liter of a compound selected from the group consisting of acrylic acid, methacrylic acid, and combinations thereof.

13. The bath according to claim 12, wherein said emulsifying agent is selected from the group consisting of a nonionic or a modified nonionic emulsifying agent.

14. The bath according to claim 13, wherein said nonionic emulsifying agent is made by condensing ethylene oxide with a lipophilic compound, said lipophilic compound selected from the group consisting of a long chain fatty alcohol, a long chain fatty amine, a long chain fatty acid, a long chain alkylphenol, naphthol, and polysaccharides, said long chain containing from about 2 to 30 carbon atoms, and wherein from about 10 to about 30 moles of said ethylene oxide are used per mole of said lipophilic compound.

15. The bath according to claim 14, wherein said chlorinated acetophenone compound has a chlorine atom substituted in the para position or the ortho position, or in both the para and one ortho position.

16. The bath according to claim 10, 11, 12, 13, 14, or 15, including from about 0.005 to about 0.2 grams/liter of at least one aromatic aldehyde selected from the group consisting of salicylaldehyde, o-methoxybenzaldehyde, o-chlorobenzaldehyde, 2,4-dichlorobenzaldehyde, 2-hydroxy-1-naphthaldehyde, o-anisaldehyde, and combinations thereof.

17. The bath according to claim 16, wherein the amount of said chlorinated acetophenone ranges from about 0.01 to about 0.05 grams per liter, wherein the amount of said emulsifying agent ranges from about 2 to about 10 grams per liter, and wherein the amount of acrylic or methacrylic acid ranges from about 0.02 to about 1.0 grams per liter, of plating bath.

18. The bath according to claim 17, wherein the amount of stannous ions ranges from about 10 to about 100 grams per liter and wherein the amount of said sulfuric acid ranges from about 50 to about 260 grams per liter of plating bath solution.

19. The bath according to claim 18, wherein said chlorinated acetophenone is selected from the group consisting of 2,4-dichloroacetophenone, 2,3,4-trichloroacetophenone, o-chloroacetophenone, and p-chloroacetophenone, and wherein the amount of said aromatic aldehyde is from about 0.005 to about 0.5 grams/liter.

* * * * *